United States Patent [19]

McLaughlin

[11] Patent Number: 4,717,042

[45] Date of Patent: Jan. 5, 1988

[54] MEDICINE DISPENSER FOR HOME HEALTH CARE

[75] Inventor: John T. McLaughlin, Glendale, Calif.

[73] Assignee: Pyxis Corporation, Salina Beach, Calif.

[21] Appl. No.: 868,660

[22] Filed: May 28, 1986

[51] Int. Cl.[4] ..... B65D 83/04

[52] U.S. Cl. ..... 221/3; 221/15; 221/197

[58] Field of Search ..... 221/2, 3, 5, 15, 69, 221/89, 90, 197; 206/534, 538; 364/479

[56] References Cited

U.S. PATENT DOCUMENTS

| | | | |
|---|---|---|---|
| 3,584,598 | 6/1971 | Gayle et al. | 221/2 X |
| 3,762,601 | 10/1973 | McLaughlin | 221/2 |
| 4,275,384 | 6/1981 | Hicks et al. | 221/2 X |
| 4,572,403 | 2/1986 | Benaroya | 221/3 |
| 4,617,557 | 10/1986 | Gordon | 206/534 X |

*Primary Examiner*—F. J. Bartuska

*Attorney, Agent, or Firm*—Kelly, Bauersfeld & Lowry

[57] ABSTRACT

A medicine dispenser includes a container having a lid and a removable compartmentalized tray which can be positioned upon an interior container ledge and held within the container interior immediately beneath the lid when closed. The tray includes a series of apertures dimensioned and positioned on the periphery of the tray to interact with a corresponding series of pegs positioned on the ledge. This arrangement permits only a properly encoded tray to be positioned within the container interior. The lid is provided a plurality of spring-loaded, hinged tray compartment covers aligned directly over corresponding tray compartments, which can be selectively opened and shut to expose the contents of any desired tray compartment. The medicine dispenser is further provided a microprocessor within the container interior which, together with a control button on the lid, controls the operation of an audible and visual alarm, as well as the automatic opening of selected compartment covers.

17 Claims, 5 Drawing Figures

MEDICINE DISPENSER FOR HOME HEALTH CARE

BACKGROUND OF THE INVENTION

This invention relates generally to medical devices, and, more specifically, to medicine dispensers for home health care which can assist patients in taking medications in dosages and at intervals as prescribed.

Some types of medical therapy require patients to take many different types of medications, often in the form of pills or capsules, at regular intervals. For invalid or ill and non-ambulatory patients, it is often desirable to minimize the number of trips to the physician or pharmacist to obtain the required amounts of medication for the therapy involved. Even for many ambulatory patients it is highly desirable to minimize the disruption caused by trips to a physician or pharmacist.

It has been found that sometimes when the physician attempts to accommodate the patient's convenience and prescribes a sufficient amount of medication for an extended period, for example one month, the different amounts and types of medications become so large that it is extremely burdensome and difficult for the patient to keep track of proper medication frequency and dosage. Moreover, it has been found that some patients find it difficult to keep track of which medications have been taken and the last time such medications were taken for purposes of maintaining the prescribed schedule. Such problems sometimes lead to the patient accidentally taking an overdose of some medications and/or not taking a sufficient dosage of others.

In an attempt to prevent such accidental overdoses and ensure that a proper medication schedule is followed, many physicians and pharmacists have recommended that accurate records be kept of the different times particular medications were taken. Even this requirement, however, has failed to be completely satisfactory because some patients either refuse to follow the physician's advice and maintain the necessary records, or they simply find record keeping a meaningless chore and neglect their responsibilities.

In addition to the foregoing, some patients requiring many medications at regular intervals are in such discomfort that the simple task of remembering a proper dosage or a time interval for taking a particular medication is in itself unduly burdensome. Although such patients often could benefit from long term medical therapy utilizing multiple medications at regular intervals, some physicians have hesitated to prescribe more than a few days of medication at any one time for fear of accidental overdoses.

Accordingly, there has been a need for a medicine dispenser designed for use in the home to assist those required to take medications at regular intervals. Such a medicine dispenser should be of durable construction, be easy to assemble and operate, and eliminate the need to keep error-free written records of dosages and time intervals prescribed. Additionally, there exists a need for a medicine dispenser which minimizes the chance of an accidental overdose or underdose of medications, and which can be constructed to ensure that only a particular combination of medications is acceptable to the device. In particular, such an improved device should allow a pharmacist to prepare the required medications, and place such medications in a tray or the like which the pharmacist knows can only be used with a corresponding medicine dispenser utilized by the patient. Further, a medicine dispenser is needed which can signal to the patient when and what kind of a particular medication is to be taken. The present invention fulfills these needs and provides other related advantages.

SUMMARY OF THE INVENTION

The present invention resides in an improved medicine dispenser for home health care which is attractive, inexpensive and can be constructed to assist a patient in following a rigid schedule for taking prescribed medications. The medicine dispenser comprises, generally, a container having a lid, and a removable compartmentalized tray which can be positioned upon an interior container ledge and held within the container interior immediately beneath the lid when closed. The container further provides means for preventing the accidental positioning of an unintended tray within the container, to help ensure that the correct medicine preparation will be used only with a particular patient's medicine dispenser. Further, a compartment cover is attached to the container lid and is capable of being shut and opened with respect to the lid to selectively permit access to the tray.

In a preferred form of the invention, the container is provided a box-like body having the lid hinged along one upper edge thereof, which lid can be locked shut to deny unwarranted access to the interior of the container. The container provides means for supporting the tray immediately beneath the lid when closed, including an interior peripheral ledge attached to the interior of the container and spaced to lay near the lid when closed so that only a peripheral lip of the medicine tray can fit between the ledge and the lid.

The means for preventing the accidental positioning of an unintended tray within the container includes a plurality of encodable peg-receiving openings which extend through the interior peripheral ledge of the container, and at least one peg which is manually insertable and removable from the peg-receiving openings. This peg is provided a head extending above the interior peripheral ledge for interacting with the tray inserted within the container.

The medicine tray is dimensioned for placement within the container and includes at least one aperture dimensioned to permit the head of the at least one peg to fit within and through it when the medicine tray is positioned within the container and the lid is shut. This medicine tray further includes a plurality of compartments for holding medicine, which each are positioned immediately beneath a respective one of a plurality of apertures through the lid when the lid is closed.

A plurality of spring-loaded compartment covers are attached to the lid adjacent respective ones of the plurality of lid apertures, and each of these compartment covers are capable of being shut and opened with respect to the lid to selectively permit access to an adjacent tray compartment for holding medicine. Each compartment cover is held in a closed position over its respective lid aperture by a solenoid-activated latch which can be activated at pre-determined time intervals by a microprocessor situated within the container below the tray.

In this regard, a compartment is preferably provided within the interior of the container for housing a battery or like power means, and a controlling means such as a programmable microprocessor. This power and controlling means is connected to the lid by a cable for selectively activating the compartment cover latches, an audible alarm, or a visual alarm in the form of a liquid crystal display. To enhance the utility of the medicine dispenser, a manually actuable control button is further mounted to the lid and electronically coupled to the power and controlling means, to facilitate use of the dispenser for the benefit of the patient.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
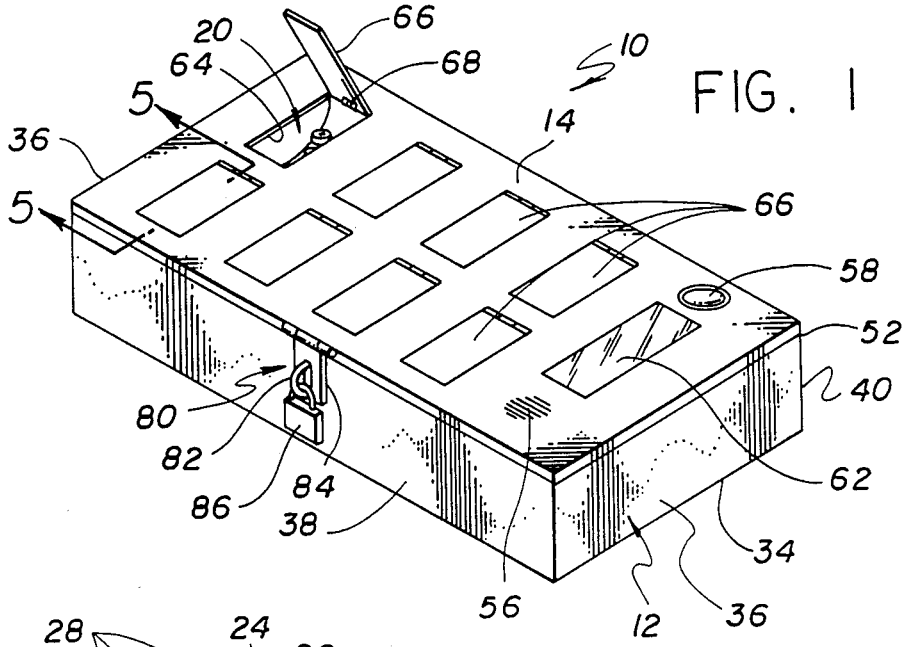
FIG. 1 is a perspective view of a preferred form of a medicine dispenser for home health care embodying the invention, and having a compartment cover opened to expose a tray compartment containing several pills therein.

As shown in the drawings for purposes of illustration, the present invention is concerned with an improved medicine dispenser for home health care, generally designated by the reference number 10. This improved medicine dispense 10 comprises, generally, a container 12 having a lid 14, and a removable, compartmentalized medicine tray 16 which can be positioned within the container immediately beneath the lid when closed. The container 10 has an interior portion 18 encoded to require the medicine tray 16 to be likewise encoded before the tray can be acceptably positioned within the container interior and the lid 14 closed thereon.

The improved medicine dispenser 10 of the present invention is designed to assist those required to take medications at regular intervals in keeping track of the frequency and dosages required. The requirement that the tray 16 be encoded to match a code placed within the container interior 18 permits a pharmacist to prepare a tray of medications which the pharmacist will know can only be used with the particular dispenser being utilized by the patient. As will become fully clear from the following description, the improved medicine dispenser 10 eliminates the need for a patient to keep error free written records of dosages and time intervals prescribed for taking medications, by signaling the patient, either through an audio or visual alarm, when a particular medication is to be taken. The improved dispenser 10 can also indicate which medication is to be taken at a specified time without permitting access to others.

In accordance with the present invention, and as illustrated in FIGS. 1–5, the preferred medicine dispenser 10 of the present invention is configured to hold up to eight different types of medications in a series of compartments 20 provided by the tray 16. Each of these compartments 20 are injection molded integrally with the medicine tray 16 to facilitate manufacture and to produce a durable and inexpensive product. These tray compartments 20 each include a lower rounded bottom portion 22 bounded by perpendicular side members 24. The medicine tray 16 further includes a tray peripheral lip 26 surrounding all the compartments 20, and the lip includes three coded apertures 28 along one side, and a power cable cut-out 30 and visual alarm cut-out 32 along the other. The purposes for these apertures and cutouts will be more fully set forth below. The box-like container 12 is constructed to have a bottom wall member 34, a pair of vertically disposed sidewall members 36, and front and rear wall members 38 and 40 disposed in a perpendicular relationship to both the bottom wall member and the sidewall members.

Within the container interior 18 is provided a peripheral ledge 42 spaced just sufficiently from the upper edge of the container wall members 36–40 to permit the medicine tray 16 to fit between the ledge and the lid 14 when the lid is closed. This ledge 42 includes a plurality of peg-receiving apertures 44 therethrough disposed generally along the side corresponding with the tray coded apertures 28.

A microprocessor/battery compartment 46 is also situated within the container interior 18, wherein power and control means may be situated to facilitate automatic operation of the medicine dispenser 10. This microprocessor/battery compartment 46 is provided with a top compartment cover 48 which includes a liquid crystal display visual alarm 50.

Figure 2:
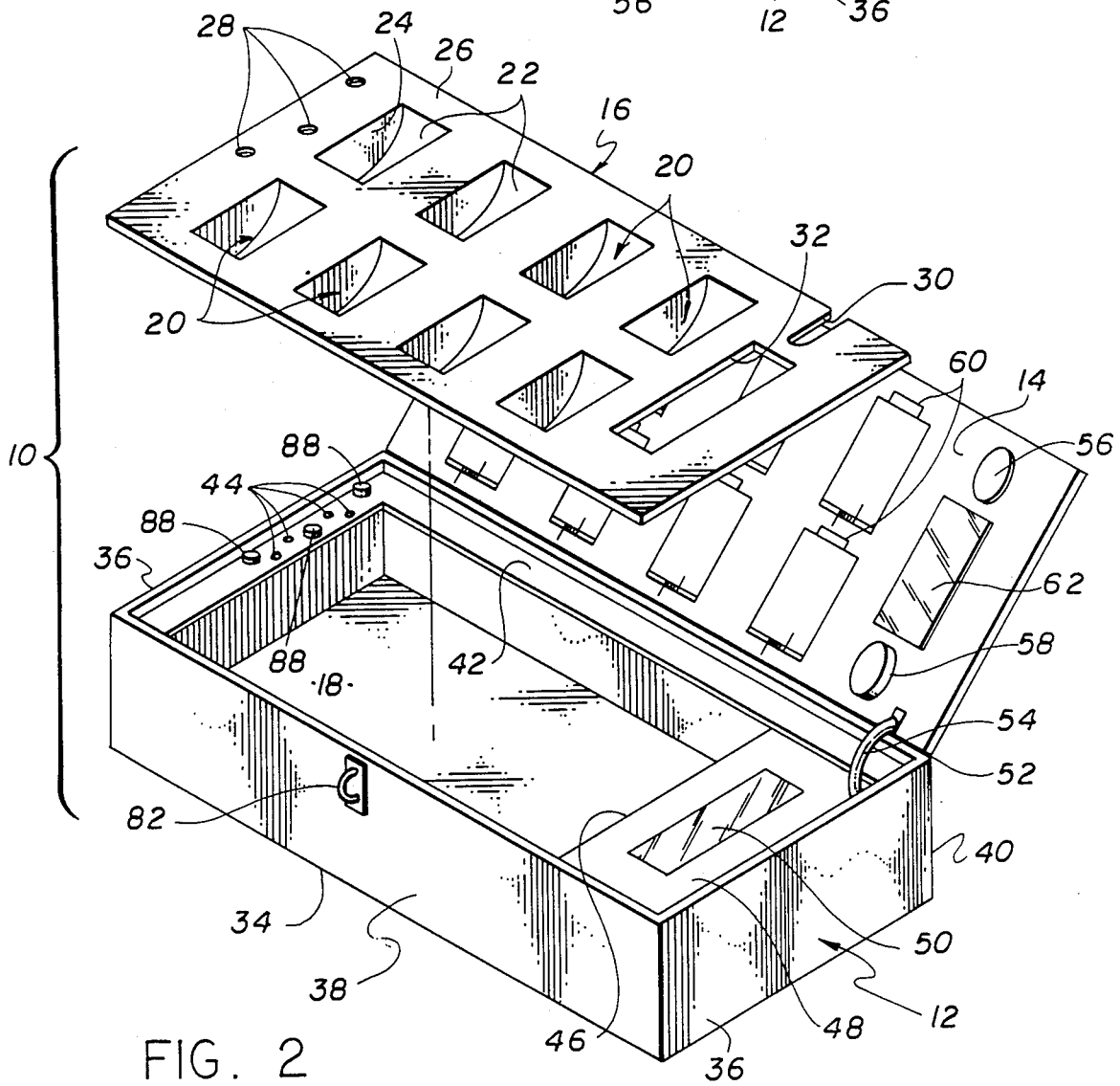
FIG. 2 is an enlarged, exploded perspective view of the medicine dispenser shown in FIG. 1, illustrating the container with its lid in an opened position to expose the interior of the container, and the removable, compartmentalized medicine tray as it would appear separated from the container.
Figure 3:
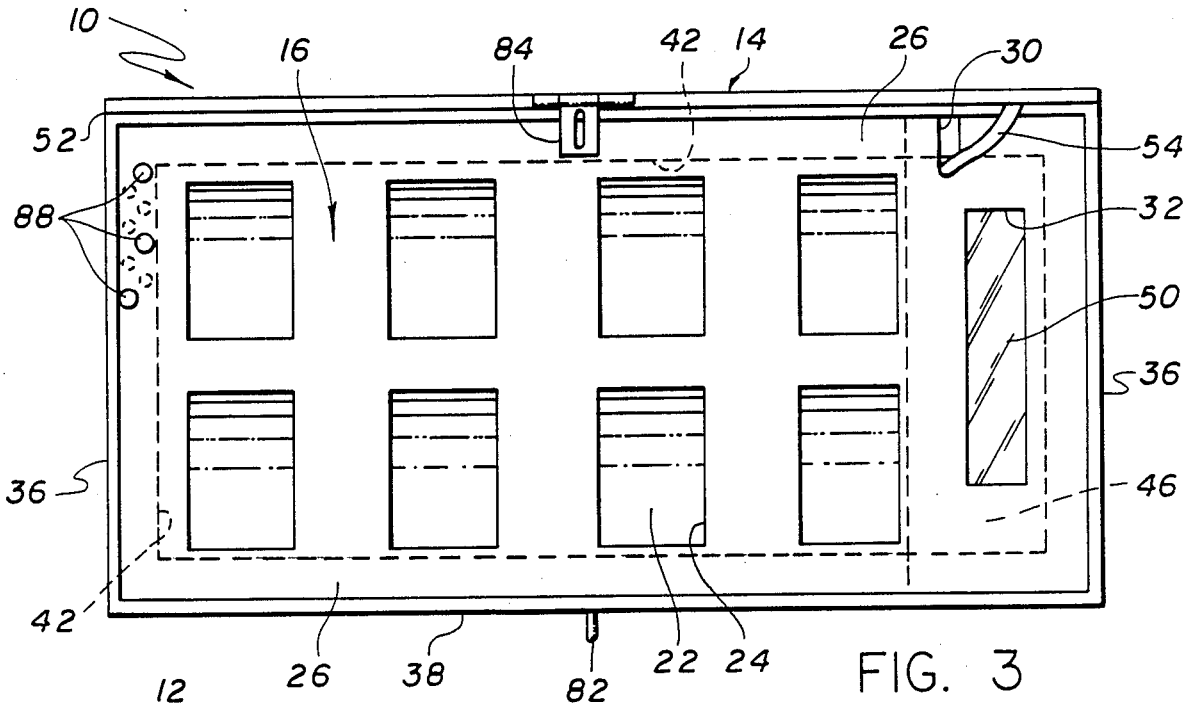
FIG. 3 is a top plan view of the medicine dispenser of FIGS. 1 and 2, as such would appear with the lid opened 90 degrees from its closed configuration and with the tray placed within the container interior.
Figure 4:
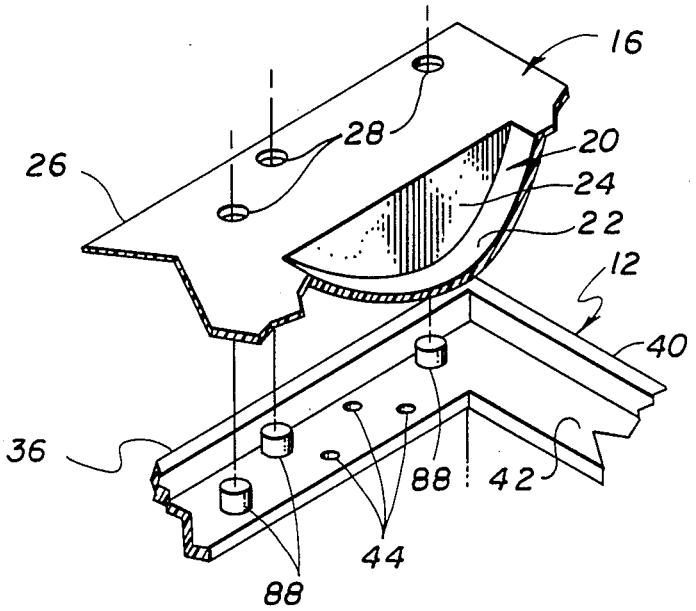
FIG. 4 is an exploded, fragmented perspective view of a portion of the container interior encoded to accept a removable, compartmentalized medicine tray which itself has been coded for the particular peg arrangement shown (which arrangement is different than that shown in FIGS. 2 and 3)

The lid 14 is connected to the container 12 by a hinge 52 along the upper edge of the rear wall member 40. The hinge is connected to the microprocessor/battery compartment 46 through a power cable 54 which extends upwardly through the microprocessor top compartment cover 48, through the power cable cutout 30, and into the lid 14 as best illustrated in FIGS. 2 and 3. Through this power cable 54, an audible alarm 56, a control button 58, and a plurality of latch solenoids 60 are electronically coupled to a microprocessor/power unit (not shown) situated within the microprocessor/battery compartment 46. The lid 14 includes a transparent portion 62 situated to lie directly over the liquid crystal display 50 when the lid is closed upon the container 12, and the audible alarm 56 and the control button 58 are positioned on either side of the transparent portion 62 so as to be positioned well away from the tray compartments 20.

Figure 5:
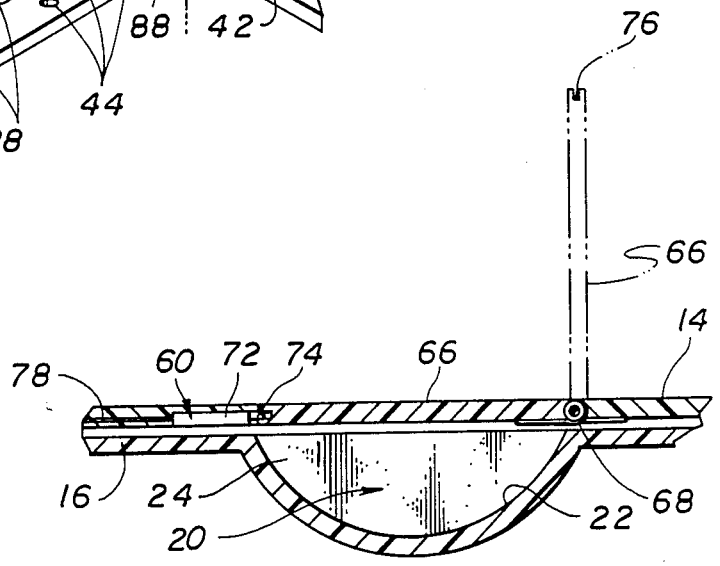
FIG. 5 is an enlarged, fragmented sectional view taken generally along the line 5—5 of FIG. 1, illustrating the relationship between the medicine tray and the lid when closed upon the container, and further showing the specific construction of a compartment cover to include the solenoid-activated latch and the position, in phantom, to which the spring-loaded compartment cover will remove itself when released.

The lid 14 is further constructed to include a plurality of apertures 64 dimensioned and situated so as to be positioned directly over the tray compartments 20 when the lid is closed upon the container 12. As best illustrated in FIG. 5, a tray compartment cover 66 is attached adjacent each of the lid apertures 64 and is loaded with a spring 68 to naturally assume an open configuration. Such an open configuration is illustrated in phantom in FIG. 5. Normally, however, the tray compartment cover 66 is closed preventing access to the underlying medicine tray compartment 20 through the lid aperture 64. Such is accomplished through use of the solenoid activated latches 60 fitted within the lid 14 opposite the attachment between the tray compartment cover 66 and the lid. Such latches 60 include a solenoid 72 having a retractable pin 74 dimensioned to fit within and interact with a channel 76 provided in the facing edge of the tray compartment cover 66. This solenoid 72 is connected by a wire 78 molded within the lid 14, which wire is electronically coupled with the control button 58 and the power/control means situated within the microprocessor/battery compartment, in a known manner.

A hasp 80 is provided the lid 14 and the container 12 to enable the lid to be secured in a closed position upon the container and prevent access to the container interior 18. As shown in FIG. 1, the hasp includes a staple 82 affixed to the exterior of the front wall member 38, and a strap 84 connected to the edge of the lid 14 opposite the hinge 52. In the closed configuration illustrated in FIG. 1, the hasp 80 would be locked in place by use of any suitable means such as the padlock 86. When the lid 14 is locked in its closed configuration over the container 12, access to the container interior 18, and more particularly to the medicine tray 16 is limited to solely through the lid apertures 64. Accordingly, it should be apparent that when the spring-loaded tray compartment covers 66 are locked shut by their respective solenoid-activated latches 60, access to the medicine tray 16 is completely prevented by the medicine dispenser 10. Only through the selective activation of these latches 60 is access to any medication permitted. A power and control means situated within the microprocessor/battery compartment 46 can conveniently and conventionally be programmed to activate the audible and/or visual alarms, and the solenoids 72 at particular time intervals, thus eliminating the need for the patient to keep accurate records of medication taken.

Since the medicine tray 16 is removable from the container interior 18, it is important that there be some means for ensuring that only a particular tray be utilized with a particular container. To this end, the coded apertures 28 in the tray peripheral lip 26 have been provided in connection with a corresponding number of pegs 88 disposed within the peg-receiving apertures 44 through the peripheral ledge 42. Each of these pegs 88 includes a lower portion (not shown) dimensioned to fit within the peg-receiving apertures 44, and an upper head dimensioned to fit within and through the tray coded apertures 28. If desired, these pegs 88 could be permanently secured within particular peg-receiving apertures 44 by gluing or the like to prevent a change in their configuration, and the heads themselves can be of various shapes, such as squares, triangles, etc.

In order for the medicine tray 16 to lie flat upon the peripheral ledge 42 within the container interior 18, the coded apertures 28 must precisely fit over the peg 88 heads, otherwise the lid 14 will not be able to close upon the container 12. As illustrated best in FIG. 4, any of the seven peg-receiving apertures 44 can be fit with a peg 88 in any desired configuration to match the particular configuration of the coded apertures 28 of the medicine tray 16. This is particularly important from the patient's point of view to help ensure that only a specified tray is used in connection with the particular medicine dispenser 10 utilized by the patient.

To use the medicine dispenser 10 described above, a physician or pharmacist would place one or more different types of medications within the tray compartments 20, and then place that tray into the container interior 18 so that its peripheral lip 26 could rest upon the peripheral ledge 42, ensuring that the coded apertures 28 properly align with the pegs 88 positioned along one side of the peripheral ledge, and the cut-outs 30 and 32 properly align with the liquid crystal display 50 and the power cable 54. If the medicine tray 16 can lie flush against the peripheral ledge 42 within the container interior 18, the physician or pharmacist would be reasonably assured that the medication prescribed for insertion within the medicine tray was intended for use with that particular dispenser 10. Once the tray 16 was inserted, the lid 14 would be pivotted about its hinge 52 to securely rest upon the upper edges of the wall members 36–40. The hasp 80 would then be locked with the padlock 86, and the spring-loaded tray compartment covers would all be closed to prevent access to the container interior 18, and specifically the compartments 20.

The power and controlling means within the microprocessor/battery compartment 46, would be programmed to activate the audible alarm 56 and/or the liquid crystal display 50 at a time scheduled for the patient to take one or more pills or capsules. For example, should the physician prescribe the taking of two different medications every four hours, the power and controlling means would be programmed to notify the user at such intervals by means of the audible alarm, which would utilize an alternating pitch of an 1800 Hertz frequency range with a volume of 75 decibels at 12 feet, and/or the flashing on the liquid crystal display 50 of a message such as "take your medicine, close the lid". When the alarm sounds, the internal circuitry of the power and controlling means, as well as the wiring throughout the lid 14, would require the user to press the control button 58 to open a first tray compartment cover 66, remove an underlying pill, close the tray compartment cover, press the control button 58 again to open a second tray compartment cover 66 (if necessary), remove another underlying pill (again if necessary), and then shut that second cover. Preferably the alarms would be activated throughout this process, and would only cease after all the required steps had been completed.

From the foregoing it is to be appreciated that the improved medicine dispenser 10 is designed for use in the home to assist those required to take medications at regular intervals, and provides an apparatus of durable construction which is easy to assemble and operate, and which eliminates the need to keep error-free written records of dosages and time intervals prescribed for taking medications. It should further be apparent that the medicine dispenser 10 of the present invention minimizes the chance of an accidental overdose or underdose of medication, and the provision of coded apertures 28 through the medicine tray which interact with pegs 88 situated within the container interior 18 help ensure that only a particular preparation of medication is accepted into and used with the device. In particular, the improved medicine dispenser 10 will permit a pharmacist to prepare a particular combination of medications with the assurance that such medications will only be utilized with the particular apparatus and intended.

Although one particular preferred embodiment of the invention has been described in detail for purposes of illustration, various modifications may be made without departing from the spirit and scope of the invention. Accordingly, the invention is not to be limited, except as by the appended claims.

I claim:

1. A medicine dispenser, comprising:

a box-like container having a lid hinged along one upper edge thereof, which lid can be locked shut to deny unwarranted access to the interior of the container, the container providing an interior peripheral ledge spaced to lie near the lid when closed, the ledge providing means for supporting a tray or the like immediately beneath the lid when closed, the lid having a plurality of apertures therethrough;

means for manually encoding the tray supporting means to prevent the accidental positioning of an unintended tray within the container, the manually encoding means including a plurality of peg-receiving openings through the interior peripheral ledge of the container, and at least one peg manually insertable and removable from the peg-receiving openings, the at least one peg having a head extending above the upper surface of the interior peripheral ledge;

a medicine tray dimensioned for placement within the container, the medicine tray including at least one aperture therethrough dimensioned and positioned to permit the head of the at least one peg to fit within and through the at least one aperture when the medicine tray is positioned within the container and the lid is shut, the medicine tray further including a plurality of compartments, each of the compartments being positioned immediately beneath a respective one of the plurality of lid apertures when the lid is closed;

a plurality of compartment covers attached to the lid adjacent respective ones of the plurality of lid apertures, each of the compartment covers capable of being shut and opened with respect to the lid to selectively permit access to respective ones of the compartments, the plurality of compartment covers being spring loaded to automatically open when a latch means included on the lid is activated to selectively release the compartment covers, the latch means including a plurality of trigger solenoids positioned, respectively, adjacent respective ones of the plurality of lid apertures opposite the attachment points of the associated compartment cover;

an interior container compartment for housing power and controlling means for the medicine dispenser;

means for connecting the power and controlling means to the lid;

an audible alarm mounted on the lid and electronically coupled with the power and controlling means;

a manually actuable control button mounted on the lid and electronically coupled with the power and controlling means; and a liquid crystal display positioned to be observable through the lid, which display is further electronically coupled with the power and controlling means.

2. A medicine dispenser, comprising:

a container having a lid which can be locked shut to deny unwarranted access to the interior of the container, the container providing means for supporting a tray or the like immediately beneath the lid when closed, the lid having a plurality of apertures therethrough;

means for manually encoding the tray supporting means to prevent the accidental positioning of an unintended tray within the container, the manually encoding means including a plurality of peg-receiving opening through an upper surface of the tray supporting means, and at least one peg manually insertable and removable from the peg-receiving openings, the at least one peg having a head extending above the tray supporting means upper surface;

a medicine tray dimensioned for placement within the container, the medicine tray including at least one aperture therethrough dimensioned and positioned to permit the head of the at least one peg to fit within and through the at least one aperture when the medicine tray is positioned within the container and the lid is shut, the medicine tray further including a plurality of compartment for holding medicine, each of the compartments being positioned immediately beneath a respective one of the plurality of lid apertures when the lid is closed; and a plurality of compartment covers attached to the lid adjacent respective ones of the plurality of lid apertures, each of the compartment covers being capable of shutting and opening with respect to the lid to selectively permit access to respective ones of the compartments for holding medicine.

3. A medicine dispenser as set forth in claim 2, wherein the container is box-like, and the lid is hinged along one upper edge thereof.

4. A medicine dispenser as set forth in claim 2, wherein the tray supporting means includes an interior peripheral ledge attached to the interior of the container and spaced to lie near the lid when closed, so that only a peripheral lip of the medicine tray can fit between the ledge and the lid.

5. A medicine dispenser as set forth in claim 4, wherein the peg-receiving openings extend through the interior peripheral ledge.

6. A medicine dispenser as set forth in claim 2, including a compartment within the interior of the container for housing power and controlling means.

7. A medicine dispenser as set forth in claim 6, including means for connecting the power and controlling means with the lid.

8. A medicine dispenser as set forth in claim 7, including an audible alarm mounted on the lid and electronically coupled with the power and controlling means.

9. A medicine dispenser as set forth in claim 7, including a manually actuable control button mounted on the lid and electronically coupled with the power and controlling means.

10. A medicine dispenser as set forth in claim 7, wherein a visual alarm is positioned to be observable through the lid and is electronically coupled to the power and controlling means.

11. A medicine dispenser as set forth in claim 10, wherein the visual alarm includes a liquid crystal display.

12. A medicine dispenser as set forth in claim 2, wherein the plurality of compartment covers are spring loaded to automatically open when a latch means included on the lid is activated to selectively release the compartment covers.

13. A medicine dispenser as set forth in claim 12, wherein the latch means includes a plurality of trigger solenoids positioned, respectively, adjacent individual ones of the plurality of lid apertures and opposite the attachment points of the associated compartment covers.

14. A medicine dispenser, comprising:

a container having a lid which can be shut to completely enclose the interior of the container, the container providing means for supporting a tray or the like immediately beneath the lid when closed, the lid having a plurality of apertures therethrough;

means for manually encoding the tray supporting means to prevent the accidental positioning of an unintended tray within the container;

a medicine tray dimensioned for placement within the container, the medicine tray including a plurality of compartments for holding medicine, and means encoded into the tray, which encoded means interacts with the means for manually encoding the tray supporting means to permit the tray to be positioned and held securely immediately beneath the lid when closed; and a plurality of compartment covers attached to the lid adjacent respective ones of the plurality of lid apertures, each of the compartment covers capable of being shut and opened with respect to the lid to selectively permit access to respective ones of the compartments, wherein each lid aperture is dimensioned and positioned to directly overlay a respective one of the tray compartments when the lid is closed.

15. A medicine dispenser as set forth in claim 14, including means for locking the lid shut against the remainder of the container to deny unwarranted access to the interior of the container.

16. A medicine dispenser as set forth in claim 14, wherein the manually encoding means includes a plurality of peg-receiving openings through an upper surface of the tray supporting means, and at least one peg manually insertable and removable from the peg-receiving openings, the at least one peg having a head extending above the tray supporting means upper surface.

17. A medicine dispenser as set forth in claim 16, wherein the means encoded into the tray includes at least one aperture through the medicine tray which is dimensioned and positioned to permit the head of the at least one peg to fit within and through the at least one aperture when the medicine tray is positioned within the container and the lid is shut.

* * * * *